US008221052B2

(12) United States Patent
Tsutsui

(10) Patent No.: US 8,221,052 B2
(45) Date of Patent: Jul. 17, 2012

(54) TURBO-MOLECULAR PUMP

(75) Inventor: Shingo Tsutsui, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 1102 days.

(21) Appl. No.: 12/117,392

(22) Filed: May 8, 2008

(65) Prior Publication Data

US 2008/0286089 A1 Nov. 20, 2008

(30) Foreign Application Priority Data

May 15, 2007 (JP) ..... 2007-129197

(51) Int. Cl.
*F04D 19/04* (2006.01)

(52) U.S. Cl. ..... 415/90; 415/143; 415/211.2; 417/423.4

(58) Field of Classification Search ..... 415/90, 415/143, 211.2; 417/423.4
See application file for complete search history.

(56) References Cited

U.S. PATENT DOCUMENTS 4,036,565 A * 7/1977 Becker ..... 415/90
5,219,269 A * 6/1993 Ikegami et al. ..... 415/55.1
5,466,119 A * 11/1995 Boivin et al. ..... 415/90
5,577,883 A * 11/1996 Schutz et al. ..... 415/90
5,695,316 A * 12/1997 Schutz et al. ..... 415/90
6,910,850 B2 * 6/2005 Nonaka et al. ..... 415/90
7,134,835 B2 * 11/2006 Gotta et al. ..... 415/90
2003/0103847 A1 6/2003 Nonaka et al.

FOREIGN PATENT DOCUMENTS

JP 01-130095 A 9/1989
JP 11-218094 A 8/1999
JP 2000-205183 A 7/2000
JP 2003-172291 A 6/2003
JP 2006-090231 A 4/2006

OTHER PUBLICATIONS

Office Action issued in Japanese Patent Application No. 2007-129197 dated Aug. 25, 2011.

* cited by examiner

*Primary Examiner* — Igor Kershteyn
(74) *Attorney, Agent, or Firm* — Sughrue Mion, PLLC

(57) ABSTRACT

Disclosed is a turbo-molecular pump, which comprises a rotor including a first cylindrical body formed with a part of a plurality of rotating blades arranged in multistage, a second cylindrical body integrally connected to an outer peripheral region of a downstream end of the first cylindrical body and formed with the remaining rotating blades, and a stress-releasing protrusion extending from the downstream end of the first cylindrical body along a direction of a rotation axis of the rotor. The turbo-molecular pump of the present invention can reduce a stress in the downstream end of the first cylindrical body.

5 Claims, 4 Drawing Sheets

TURBO-MOLECULAR PUMP

BACKGROUND OF THE INVENTION

1. Field of the Invention

The present invention relates to a turbo-molecular pump.

2. Description of the Related Art

Heretofore, a turbo-molecular pump has been used as a pump for evacuating an inside of a process chamber to perform a given treatment in a high vacuum atmosphere during a semiconductor manufacturing process. The turbo-molecular pump comprises a rotor which has a plurality of rotating blades formed in an outer peripheral surface of a bell-shaped cylindrical body thereof, in a multistage arrangement. In view of a need for each of the rotating blades to achieve a higher compression ratio as it is located on a more downstream side, a downstream cylindrical body provided with a part of the rotating blades located in a downstream region (i.e., downstream rotating blades) is designed to have an outer diameter greater than that of an upstream cylindrical body provided with the remaining rotating blades located in an upstream region (i.e., upstream rotating blades), in order to provide a higher peripheral speed to a root portion of each of the downstream rotating blades (see, for example, JP 2006-090231A).

In a portion of the upstream cylindrical body integrally connected to the downstream cylindrical body, the downstream cylindrical body is applied thereto as an additional mass to cause an increase in stress in a downstream end of the upstream cylindrical body. Moreover, there is a problem that, when it is attempted to increase a rotation speed of the rotor so as to obtain enhanced evacuation performance, an upper limit of the rotor rotation speed will be undesirably restricted by the stress in the downstream end.

SUMMARY OF THE INVENTION

In view of the above circumstances, it is an object of the present invention to provide a turbo-molecular pump comprising upstream and downstream cylindrical bodies provided with a plurality of rotating blades in a multistage arrangement, capable of reducing a stress in a downstream end of the upstream cylindrical body.

In order to achieve this object, the present invention provides a turbo-molecular pump which comprises a rotor formed with a plurality of rotating blades in a multistage arrangement and adapted to be rotated at a high speed so as to perform an evacuation operation. The rotor includes: a first cylindrical body formed with a part of the plurality of rotating blades; a second cylindrical body integrally connected to an outer peripheral region of a downstream end of the first cylindrical body, and formed with the remaining rotating blades; and a stress-releasing protrusion extending from the downstream end of the first cylindrical body along a direction of a rotation axis of the rotor.

The first cylindrical body may be formed in a conical shape.

The turbo-molecular pump may further include a screw stator which extends to have a distal edge located between the second cylindrical body and the protrusion, so that an outer peripheral surface of the screw stator forms thread groove pumping means in cooperation with an inner peripheral surface of the second cylindrical body.

The screw stator may have an upstream end formed with a convex portion protruding toward the protrusion, and the inner peripheral surface of the second cylindrical body may be formed with a concave portion in opposed relation to the convex portion.

As above, in the present invention, the downstream end of the first cylindrical body integrally connected with the second cylindrical body is provided with the stress-releasing protrusion extending along a direction of a rotation axis of the rotor. This makes it possible to reduce a stress in the downstream end of the first cylindrical body.

DESCRIPTION OF THE EXEMPLARY EMBODIMENTS

Figure 1:
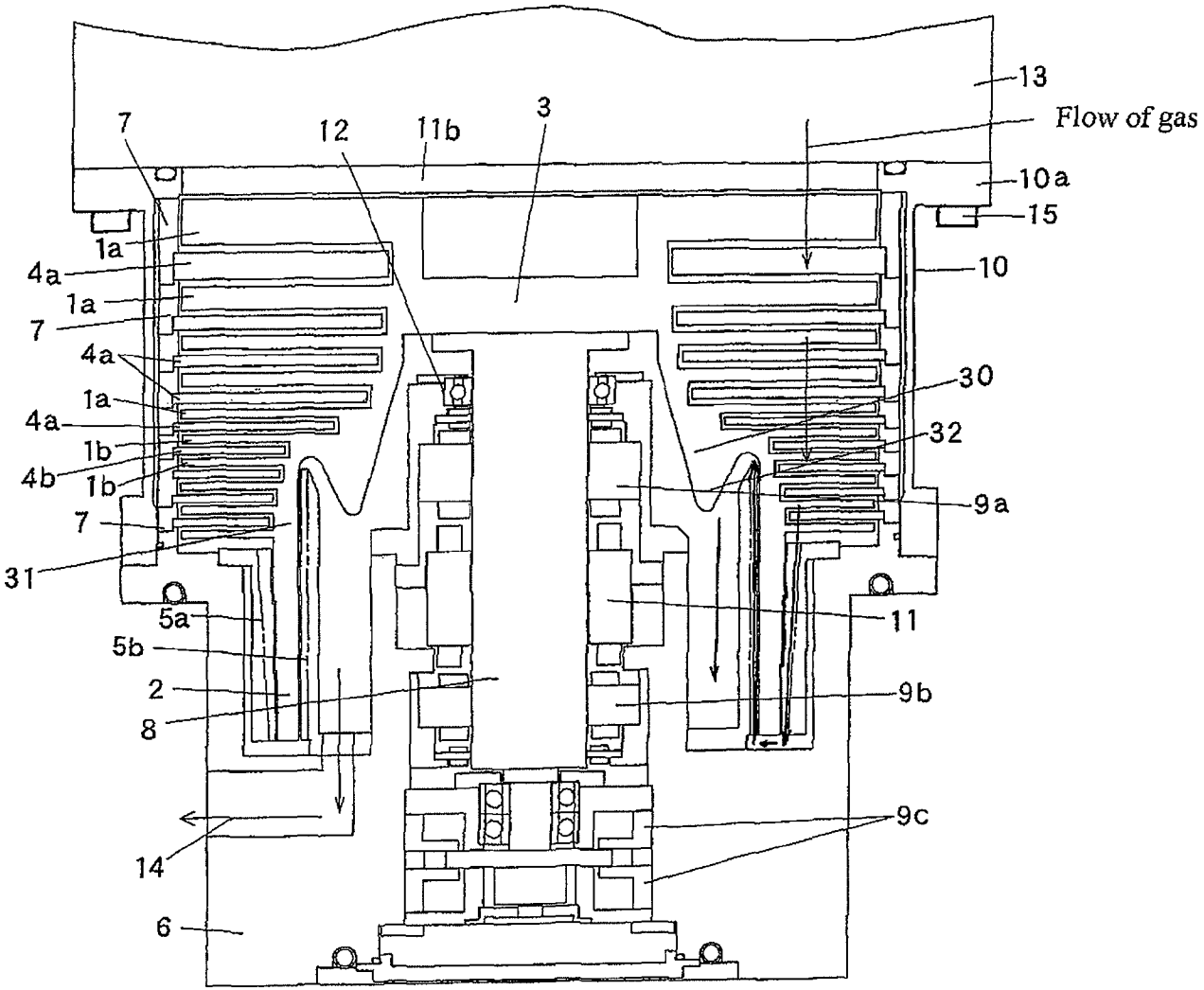
FIG. 1 is a sectional view showing a turbo-molecular pump according to one embodiment of the present invention.

With reference to the drawings, the present invention will be specifically described based on an exemplary embodiment thereof. FIG. 1 is a sectional view schematically showing the structure of a turbo-molecular pump according to one embodiment of the present invention. As shown in FIG. 1, the turbo-molecular pump comprises: a rotor 3 formed with a plurality of rotating blades 1*a*, 1*b* in a multistage arrangement and a cylindrical-shaped screw rotor portion 2; a plurality of stationary blades 4*a*, 4*b*; and two screw stators 5*a*, 5*b*; and a pump casing 10 housing the above components. In the turbo-molecular pump illustrated in FIG. 1, a combination of the rotating blades 1*a*, 1*b* and the stationary blades 4*a*, 4*b* makes up a turbo-molecular pumping section on a high-vacuum side, and a combination of the screw rotor portion 2 and the screw stators 5*a*, 5*b* makes up a thread groove pumping section on a low-vacuum side.

Each of the rotating blades 1*a* and the stationary blades 4*a* disposed on an upstream side of the turbo-molecular pumping section has a relatively long blade length, and each of the rotating blades 1*b* and the stationary blades 4*b* disposed on a downstream side of the turbo-molecular pumping section has a relatively short blade length. In the following description, the rotating blades 1*a* and the stationary blades 4*a* on the upstream side will be referred to respectively as "upstream rotating blades 1*a*" and "upstream stationary blades 4*a*", and the rotating blades 1*b* and the stationary blades 4*b* on the downstream side will be referred to respectively as "downstream rotating blades 1*b*" and "downstream stationary blades 4*b*". Each of the upstream stationary blades 4*a* and the downstream stationary blades 4*b* is positioned and fixed by a plurality of spacer rings 7 stacked on a base member 6.

In the thread groove pumping section, the screw stator 5*a* is disposed in opposed relation to an outer peripheral surface of the screw rotor portion 2 with a small gap therebetween, and the screw stator 5*b* is disposed in opposed relation to an inner peripheral surface of the screw rotor portion 2 with a small gap therebetween. The screw stators 5*a*, 5*b* are fixed to the base member 6 by a bolt or the like.

The rotor 3 is attached to a rotary shaft 8. The rotary shaft 8 is adapted to be supported by a plurality of electromagnets 9*a*, 9*b*, 9*c* for a magnetic bearing system, and drivenly rotated by a motor 11. When the magnetic bearing system is not activated, the rotary shaft 8 is supported by a mechanical bearing 12. The pump casing 10 and the base member 6 are integrated together by a bolt or the like. The pump casing 10 has a flange 10*a* adapted to be fastened to a flange of a target apparatus 13 by a bolt 15 so as to allow the turbo-molecular pump to be mounted to the target apparatus 13.

When the rotary shaft 8 and the rotor 3 are rotated at a high speed by the motor 11, an evacuation function is produced in each of the turbo-molecular pumping section and the thread groove pumping section. Thus, gas on the side of an inlet port 11*b* is evacuated in a direction indicated by the arrows. The gas pumped out from the turbo-molecular pumping section to the thread groove pumping section is pumped out downwardly (in FIG. 1) by an action of the screw rotor portion 3 and the screw stator 5*a*, and then directed upwardly (in FIG. 1) through the gap between the screw rotor section 2 and the screw stator 5*b*. The base member 6 is formed with a discharge port 14 fluidically connected to a low-vacuum pump. Thus, the gas pumped out of the thread groove pumping section is discharged to an outside of the pump through the low-vacuum pump.

Figure 2:
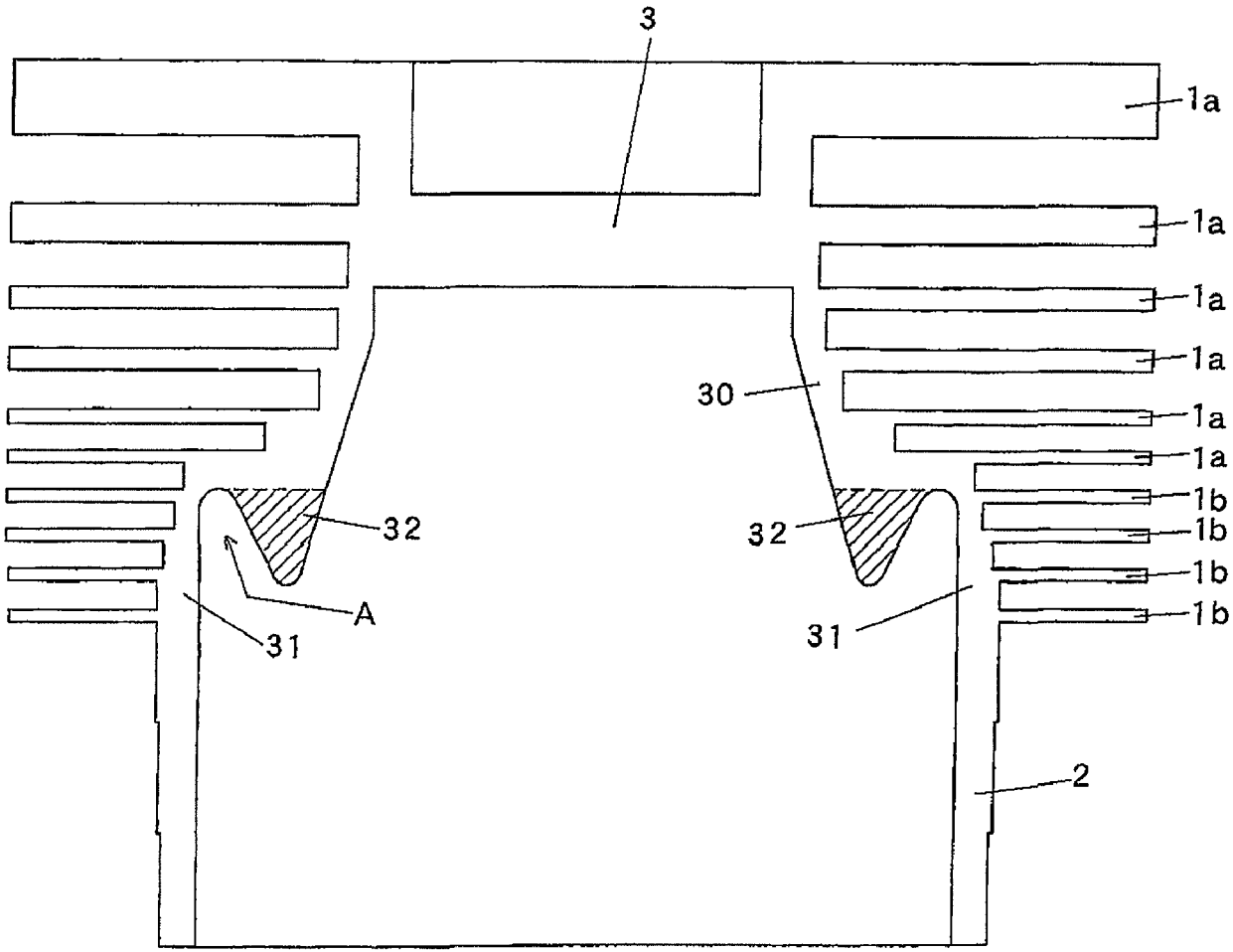
FIG. 2 is a sectional view showing a rotor 3 of the turbo-molecular pump.

FIG. 2 is a sectional view showing the rotor 3. As shown in FIG. 2, the rotor 3 has a bell-shaped cylindrical body having the rotating blades 1*a*, 1*b* and the screw rotor portion 2 formed thereon. Each of the rotating blades 1*a*, 1*b* provided in a multistage arrangement along a direction of a rotation axis of the rotor 3 is designed to achieve a higher compression ratio as it is located on a more downstream side. For this purpose, the length of each of the downstream rotating blades 1*b* is set to be less than that of each of the upstream rotating blades 1*a*. Thus, each of the downstream rotating blades 1*b* can have a higher peripheral speed in a root portion thereof, as compared with the upstream rotating blades 1*a*, to provide enhanced evacuation performance.

The bell-shaped cylindrical body of the rotor 3 comprises an upstream cylindrical body 30 having the upstream rotating blades 1*a* formed thereon, and a downstream cylindrical body 31 having the downstream rotating blades 1*b* and the screw rotor portion 2 formed thereon. The upstream cylindrical body 30 is formed in a conical shape having a diameter which gradually increases in a downstream direction. The downstream cylindrical body 31 is formed to have a diameter greater than that in a downstream end of the upstream cylindrical body 30. A bottom of the downstream (in FIG. 3, lower) end of the upstream cylindrical body 30 has a protrusion 32 (shaded area) formed to protrude in the downstream (in FIG. 3, downward) direction. Specifically, the protrusion 32 is formed to extend from the downstream end of the upstream cylindrical body 30 downwardly, and have a radial thickness which gradually decreases in the downstream direction.

The downstream cylindrical body 31 with a larger diameter than that of the upstream cylindrical body 30 receives a larger centrifugal force according to rotation of the rotor. In addition, the downstream cylindrical body 31 acts as an additional mass which leads to a larger centrifugal force around the downstream end of the upstream cylindrical body 30. Consequently, in conventional turbo-molecular pumps, a stress in the downstream end of the upstream cylindrical body 30 is increased to impose restrictions on an upper limit of rotation speed of the rotor.

In this embodiment, the protrusion 32 is formed to extend from the bottom of the downstream end of the upstream cylindrical body 30 in the downstream direction along a rotation axis (i.e., the rotary shaft) of the rotor. Thus, the upstream cylindrical body 30 and the protrusion 32 may be considered as a single piece of cylindrical body. This makes it possible to distribute a stress in the downstream end to the protrusion 32 so as to reduce the stress in the downstream end. In addition, the upstream cylindrical body 30 formed in a conical shape can have a uniform stress distribution.

Therefore, the upper limit of the rotor rotation speed can be increased to achieve enhanced evacuation performance of the turbo-molecular pump. Additionally, a distal edge (in FIG. 3, upper end) of the screw stator 5*b* is extended into a space A defined between the protrusion 32 and the downstream cylindrical body 31. Thus, in addition to the inner peripheral surface of the screw rotor portion 2, an inner peripheral surface of the downstream cylindrical body 31 corresponding to a region having the downstream rotating blades 1*b* formed thereon can be used as a part of the thread groove pumping section. This makes it possible to increase a length of a pumping path of the thread groove pumping section so as to achieve higher compression ratio and higher pumping speed during high flow pumping. If the evacuation performance is set at conventional level, an axial dimension of the screw rotor portion 2 can be reduced to facilitate reduction in axial size of the pump.

Furthermore, in the event of breakage of the rotor, the protrusion 32 collides with a region of the screw stator 5*b* extended into the space A, so that the screw stator 5*b* can be deformed to absorb a part of energy during breakage of the rotor. This makes it possible to reduce a shock to be transferred to the pump casing 10 so as to reduce shack energy to be applied to the pump-fastening bolt 15 to prevent breakage of the bolt 15.

Figure 3:
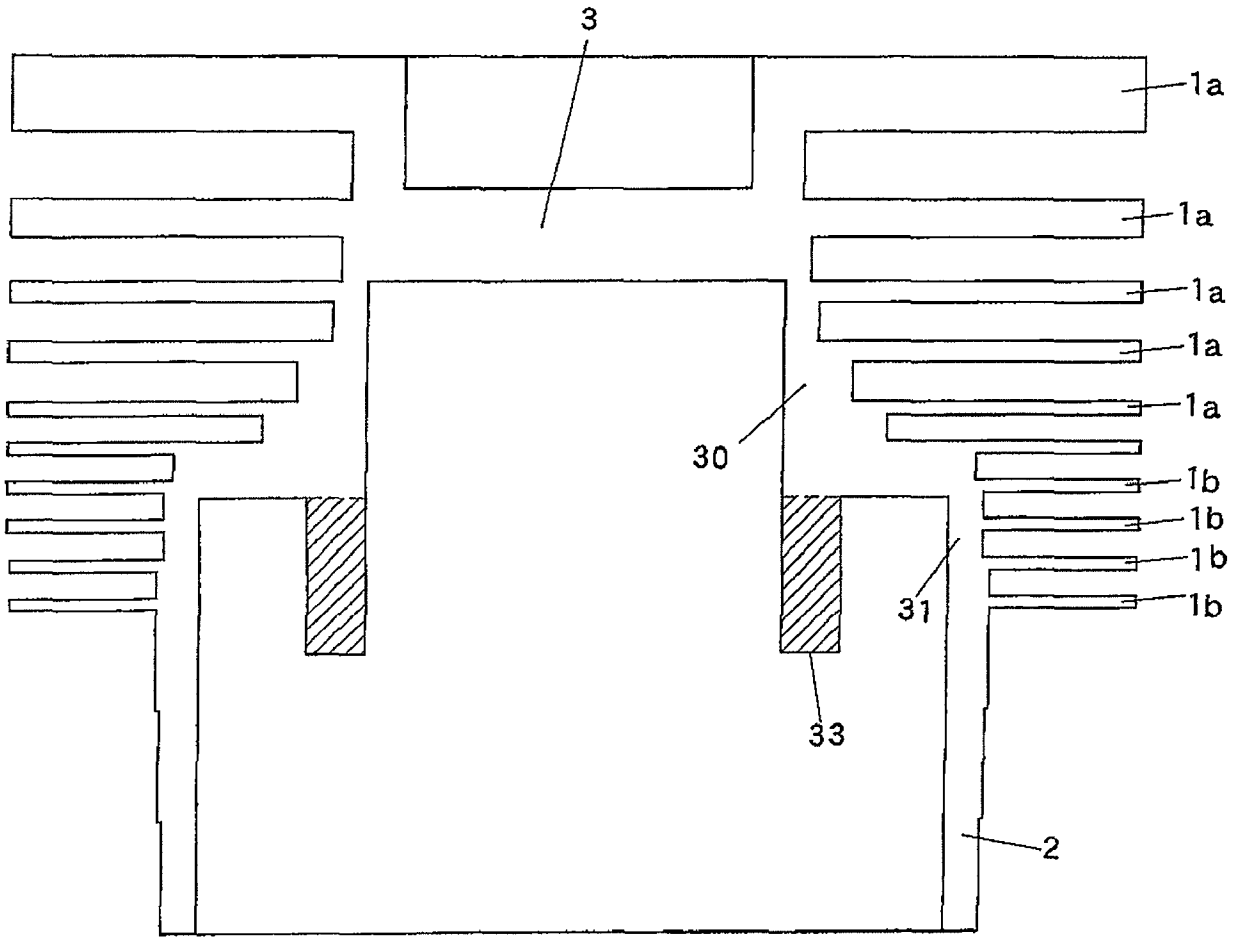
FIG. 3 is a sectional view showing one example of modification of a protrusion in the rotor 3, wherein a protrusion 33 is formed in a rectangular shape in section.

In the above embodiment, the protrusion 32 having a triangular shape in section is formed in the downstream end of the upstream cylindrical body 30. Alternatively, as shown in FIG. 3, a protrusion 33 having a rectangular shape in section may be formed. This protrusion 33 can achieve the same advantages as those in the protrusion 32 illustrated in FIG. 2.

Figure 4:
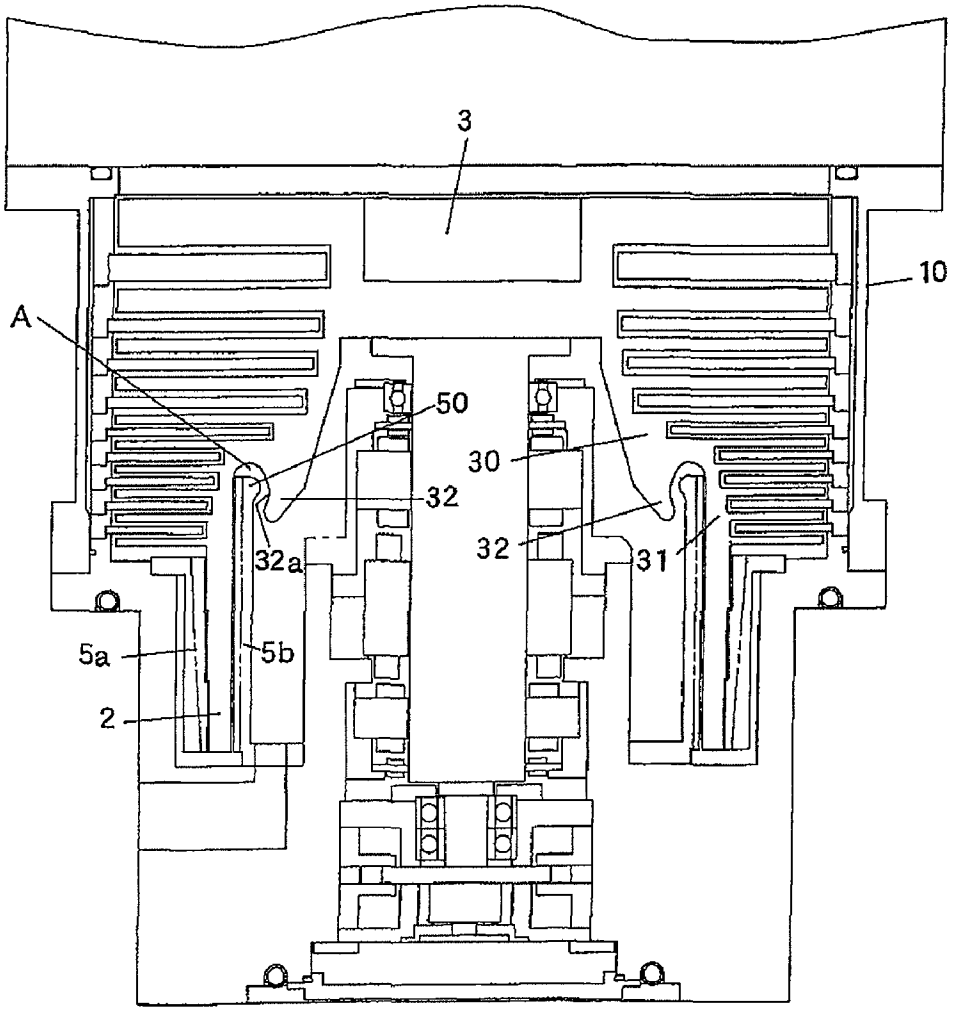
FIG. 4 is a sectional view showing one example of a modification of the turbo-molecular pump.

FIG. 4 is a sectional view showing one example of a modification of the aforementioned turbo-molecular pump. This modification is intended to provide enhanced rotor-restraining function in the event of breakage of the pump, based on the screw stator 5*b*. In the event of breakage of the rotor, resulting broken rotor pieces move in a slightly upward direction, instead of a horizontally outward direction. Thus, in a configuration of the protrusion 32 and the screw stator 5*b* illustrated in FIG. 1, an upper portion of the screw stator 5*b* is deformed toward the pump casing to have a mortar-like shape, due to collision with the broken rotor pieces, and thereby the protrusion 32 on the side of the rotor is likely to be disengaged from the screw stator 5*b*.

In the modification illustrated in FIG. 4, a convex portion 50 is formed on an inner peripheral surface of the region of the screw stator 5*b* extended into the space A, and a concave portion 32*a* is formed in an outer surface of the protrusion 32, in opposed relation to the convex portion 50. Thus, in the event of breakage of the rotor, even if the screw stator 5*b* is deformed, this configuration can reduce a risk of release of an engagement between the concave portion 32*a* on the side of the rotor and the convex portion 50 of the screw stator 5*b*. This makes it possible to prevent broken rotor pieces from colliding with the pump casing 10.

The above embodiment has been described by taking the turbo-molecular pump having the turbo-molecular pumping section and the thread groove pumping section, as one example. Alternatively, the present invention may be applied to a turbo-molecular pump having only a turbo-molecular pumping section comprising a combination of the rotating blades 1*a*, 1*b* and the stationary blades 4*a*, 4*b*. Furthermore, the present invention may be applied to a turbo-molecular pump other than the magnetic bearing type. It is understood that the present invention is not limited to the above embodiment, but various changes and modifications may be made therein without departing from the spirit and scope of the present invention as set forth in appended claims.

In a correspondence between the above embodiment and elements of the appended claims, the upstream cylindrical body 30 serves as the first cylindrical body, and the downstream cylindrical body 31 serves as the second cylindrical body. This correspondence between the above embodiment and elements of the appended claims is described only by way of example, and this description is not meant to be construed in a limiting sense.

What is claimed is:

1. A turbo-molecular pump comprising:

a rotor which is formed with a plurality of rotating blades in a multistage arrangement, and adapted to be rotated at a high speed so as to perform an evacuation operation, said rotor including a first cylindrical body formed with a part of said plurality of rotating blades;

a second cylindrical body integrally connected to an outer peripheral region of a downstream end of said first cylindrical body, and formed with the remaining rotating blades;

a screw rotor portion which extends from said second cylindrical body along a direction of a rotation axis of said rotor; and a stress-releasing protrusion which extends from the downstream end of said first cylindrical body along the direction of the rotation axis of said rotor; and a first screw stator which extends to have a distal edge located between said screw rotor portion and said protrusion; and a second screw stator which extends to have a distal edge located on an opposite side of said screw rotor portion with respect to said first screw stator portion.

2. The turbo-molecular pump as defined in claim 1, wherein said first cylindrical body is formed in a conical shape.

3. The turbo-molecular pump as defined in claim 1, wherein said first screw stator has an upstream end formed with a convex portion protruding toward said protrusion; and the inner peripheral surface of said protrusion is formed with a concave portion in opposed relation to said convex portion.

4. A turbo-molecular pump comprising a rotor which is formed with a plurality of rotating blades in a multistage arrangement, and adapted to be rotated at a high speed so as to perform an evacuation operation, said rotor including:

a first cylindrical body formed with a part of said plurality of rotating blades;

a second cylindrical body integrally connected to an outer peripheral region of a downstream end of said first cylindrical body, and formed with the remaining rotating blades; and a stress-releasing protrusion which extends at said rotor from the bottom of the downstream end of said first cylindrical body along a direction of a rotation axis of said rotor; and a screw stator which extends to have a distal edge located between said second cylindrical body and said protrusion, so that an outer peripheral surface of said screw stator forms thread groove pumping means in cooperation with an inner peripheral surface of said second cylindrical body wherein said screw stator has an upstream end formed with a convex portion protruding toward said protrusion; and the inner peripheral surface of said protrusion is formed with a concave portion in opposed relation to said convex portion.

5. The turbo-molecular pump as defined in claim 4, wherein said first cylindrical body is formed in a conical shape.

* * * * *